US008638965B2

(12) United States Patent
Higgins et al.

(10) Patent No.: US 8,638,965 B2
(45) Date of Patent: Jan. 28, 2014

(54) RECEIVER-IN-CANAL HEARING DEVICE CABLE CONNECTIONS

(75) Inventors: Sidney A. Higgins, Maple Grove, MN (US); Curt Johnson, Loretto, MN (US); Thomas Spaulding, Eden Prairie, MN (US); Thomas Blaise Bergner, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 151 days.

(21) Appl. No.: 13/181,752

(22) Filed: Jul. 13, 2011

(65) Prior Publication Data

US 2012/0014549 A1 Jan. 19, 2012

Related U.S. Application Data

(60) Provisional application No. 61/364,358, filed on Jul. 14, 2010.

(51) Int. Cl.
*H04R 25/00* (2006.01)

(52) U.S. Cl.
USPC ..... 381/330; 381/381

(58) Field of Classification Search
USPC ..... 381/330, 381
See application file for complete search history.

(56) References Cited

U.S. PATENT DOCUMENTS

| | | | |
|---|---|---|---|
| 2,327,320 | A | 8/1943 | Shapiro |
| 3,728,509 | A | 4/1973 | Shimojo |
| 3,812,300 | A | 5/1974 | Brander et al. |
| 4,017,834 | A | 4/1977 | Cuttill et al. |
| 4,310,213 | A | 1/1982 | Fetterolf, Sr. et al. |
| 4,571,464 | A | 2/1986 | Segero |
| 4,729,166 | A | 3/1988 | Lee et al. |
| 5,606,621 | A | 2/1997 | Reiter et al. |
| 5,687,242 | A | 11/1997 | Iburg |
| 5,708,720 | A | 1/1998 | Meyer |

(Continued)

FOREIGN PATENT DOCUMENTS

| | | | |
|---|---|---|---|
| DE | 3006235 | A1 | 10/1980 |
| DE | 3643124 | A1 | 7/1988 |

(Continued)

OTHER PUBLICATIONS

U.S. Appl. No. 11/857,439 , Response filed Dec. 17, 2011 to Non Final Office Action mailed Aug. 17, 2011, 12 pgs.

(Continued)

*Primary Examiner* — Davetta W Goins
*Assistant Examiner* — Amir Etesam
(74) *Attorney, Agent, or Firm* — Schwegman Lundberg & Woessner, P.A.

(57) ABSTRACT

Disclosed herein, among other things, are methods and apparatus for hearing assistance devices, including, but not limited to connections for receiver-in-canal hearing devices. In various embodiments, a hearing device includes a hearing device component adapted to rest on or behind the ear and hearing assistance electronics disposed in the component. A first connector portion is disposed in the component, the first connector portion electrically connected to the hearing assistance electronics. A second connector portion is adapted to conform to a portion of the component and to electrically and physically connect a cable to the first connector portion. In various embodiments, at least one of the first connector portion and the second connector portion employ scratch pads for contacts. The first connector portion is top loading, in an embodiment.

20 Claims, 4 Drawing Sheets

(56) References Cited

U.S. PATENT DOCUMENTS

| | | | | |
|---|---|---|---|---|
| 5,755,743 | A | 5/1998 | Volz et al. | |
| 5,824,968 | A | 10/1998 | Packard et al. | |
| 5,987,146 | A | 11/1999 | Pluvinage et al. | |
| 6,031,923 | A | 2/2000 | Gnecco et al. | |
| 6,766,030 | B1 | 7/2004 | Chojar | |
| 6,876,074 | B2 | 4/2005 | Kim | |
| 7,016,512 | B1 * | 3/2006 | Feeley et al. | 381/324 |
| 7,110,562 | B1 | 9/2006 | Feeley et al. | |
| 7,139,404 | B2 | 11/2006 | Feeley et al. | |
| 7,142,682 | B2 * | 11/2006 | Mullenborn et al. | 381/322 |
| 7,256,747 | B2 | 8/2007 | Victorian et al. | |
| 7,446,720 | B2 | 11/2008 | Victorian et al. | |
| 7,471,182 | B2 | 12/2008 | Kumano et al. | |
| 7,593,538 | B2 | 9/2009 | Polinske | |
| 8,098,863 | B2 | 1/2012 | Ho et al. | |
| 8,295,517 | B2 | 10/2012 | Gottschalk et al. | |
| 8,385,573 | B2 | 2/2013 | Higgins | |
| 2003/0178247 | A1 | 9/2003 | Saltykov | |
| 2003/0200820 | A1 | 10/2003 | Takad et al. | |
| 2004/0114776 | A1 | 6/2004 | Crawford et al. | |
| 2004/0240693 | A1 | 12/2004 | Rosenthal | |
| 2005/0008178 | A1 | 1/2005 | Joergensen et al. | |
| 2006/0097376 | A1 | 5/2006 | Leurs et al. | |
| 2006/0159298 | A1 * | 7/2006 | von Dombrowski et al. | 381/330 |
| 2007/0036374 | A1 | 2/2007 | Bauman et al. | |
| 2007/0121979 | A1 | 5/2007 | Zhu et al. | |
| 2007/0188289 | A1 | 8/2007 | Kumano et al. | |
| 2008/0003736 | A1 | 1/2008 | Arai et al. | |
| 2008/0026220 | A9 | 1/2008 | Bi et al. | |
| 2008/0187157 | A1 | 8/2008 | Higgins | |
| 2008/0199971 | A1 | 8/2008 | Tondra | |
| 2008/0260193 | A1 * | 10/2008 | Westermann et al. | 381/330 |
| 2009/0074218 | A1 | 3/2009 | Higgins | |
| 2009/0075083 | A1 | 3/2009 | Bi et al. | |
| 2009/0196444 | A1 | 8/2009 | Solum | |
| 2009/0245558 | A1 | 10/2009 | Spaulding | |
| 2009/0262964 | A1 | 10/2009 | Havenith et al. | |
| 2010/0034410 | A1 | 2/2010 | Link et al. | |
| 2010/0074461 | A1 | 3/2010 | Polinske | |
| 2010/0124346 | A1 | 5/2010 | Higgins | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2012/0263328 | A1 | 10/2012 | Higgins | |

FOREIGN PATENT DOCUMENTS

| | | | |
|---|---|---|---|
| DE | 4005476 | A1 | 7/1991 |
| DE | 4233813 | C1 | 11/1993 |
| DE | 29801567 | U1 | 5/1998 |
| EP | 0339877 | A3 | 11/1989 |
| EP | 0866637 | A2 | 9/1998 |
| EP | 1065863 | A2 | 1/2001 |
| EP | 1465457 | A2 | 10/2004 |
| EP | 1496530 | A2 | 1/2005 |
| EP | 1811808 | A1 | 7/2007 |
| EP | 1816893 | A1 | 8/2007 |
| EP | 2040343 | A1 | 3/2009 |
| GB | 1298089 | | 11/1972 |
| GB | 1522549 | | 8/1978 |
| JP | 2209967 | A | 8/1990 |
| JP | 2288116 | A | 11/1990 |
| JP | 09199662 | | 7/1997 |
| WO | WO-2004025990 | A1 | 3/2004 |
| WO | WO-2006094502 | A1 | 9/2006 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |
| WO | WO-2011101041 | A1 | 8/2011 |

OTHER PUBLICATIONS

U.S. Appl. No. 11/857,439, Final Office Action mailed Feb. 29, 2012, 16 pgs.
U.S. Appl. No. 11/857,439, Response filed Apr. 30, 2012 to Final Office Action mailed Feb. 29, 2012, 9 pgs.
U.S. Appl. No. 12/027,173, Final Office Action mailed Dec. 8, 2011, 12 pgs.
U.S. Appl. No. 12/548,051, Response filed Jan. 12, 2012 to Non Final Office Action mailed Oct. 12, 2011, 9 pgs.
U.S. Appl. No. 12/548,051,Final Office Action mailed Apr. 19, 2012, 12 pgs.
U.S. Appl. No. 11/857,439, Non Final Office Action mailed Aug. 17, 2011, 16 pgs.
U.S. Appl. No. 11/857,439, Response filed Jun. 13, 2011 to Restriction Requirement mailed May 11, 2011, 8 pgs.
U.S. Appl. No. 11/857,439, Restriction Requirement Action mailed May 11, 2011, 6 pgs.
U.S. Appl. No. 12/027,173, Non Final Office Action mailed Jul. 11, 2011, 10 pgs.
U.S. Appl. No. 12/027,173, Response filed Nov. 14, 2011 to Non Final Office Action mailed Jul. 11, 2011, 8 pgs.
U.S. Appl. No. 12/548,051, Non Final Office Action mailed Oct. 12, 2011, 11 pgs.
European Application Serial No. 08253065.0, European Office Action mailed Aug. 26, 2010, 6 Pgs.
European Application Serial No. 08253065.0, Extended Search Report Mailed Dec. 15, 2008, 9 pgs.
European Application Serial No. 08253065.0, Office Action mailed Jul. 17, 2009, 1 pg.
European Application Serial No. 08253065.0, Response to Office Action filed Feb. 28, 2011 to European Office Action mailed Aug. 26, 2010, 17 pgs.
European Application Serial No. 08725262.3, Office Action mailed Apr. 21, 2010, 6 Pgs.
European Application Serial No. 08725262.3, Office Action Response Filed Nov. 2, 2010, 14 pgs.
European Application Serial No. 09168844.0, European Search Report mailed Apr. 19, 2010, 3 Pgs.
European Application Serial No. 09168844.0, Office Action mailed May 3, 2010, 5 pgs.
European Application Serial No. 09168844.0, Office Action Response Filed: Nov. 15, 2010, 8 pgs.
European Application Serial No. 09250729.2, Extended Search Report Mailed Dec. 14, 2009, 4 pgs.
International Application Serial No. PCT/US2008/001609, Search Report mailed Jun. 19, 2008, 7 pgs.
International Application Serial No. PCT/US2008/001609, Written Opinion mailed Jun. 19, 2008, 8 pgs.
Buchoff, L S, "Advanced Non-Soldering Interconnection", Electro International, 1991 (IEEE), XP 10305250A1, (1991), 248-251.
Tondra, Mark, "Flow Assay With Integrated Detector", U.S. Appl. No. 60/887,609, filed Feb. 1, 2007, 28 pgs.
U.S. Appl. No. 11/857,439, Notice of Allowance mailed May 30, 2012, 9 pgs.
U.S. Appl. No. 11/857,439, Notice of Allowance mailed Sep. 19, 2012, 9 pgs.
U.S. Appl. No. 12/027,173, Non Final Office Action mailed Jul. 27, 2012, 11 pgs.
U.S. Appl. No. 12/027,173, Notice of Allowance mailed Mar. 19, 2013, 8 pgs.
U.S. Appl. No. 12/027,173, Response filed Jun. 8, 2012 to Final Office Action mailed Dec. 8, 2011, 7 pgs.
U.S. Appl. No. 12/027,173, Response filed Dec. 26, 2012 to Non Final Office Action mailed Jul. 27, 2012, 8 pgs.
U.S. Appl. No. 12/539,195, Advisory Action mailed Apr. 23, 2013, 3 pgs.
U.S. Appl. No. 12/539,195, Final Office Action mailed Feb. 11, 2013, 15 pgs.
U.S. Appl. No. 12/539,195, Non Final Office Action mailed Jul. 20, 2012, 13 pgs.
U.S. Appl. No. 12/539,195, Response filed Apr. 11, 2013 to Final Office Action mailed Feb. 11, 2013, 7 pgs.
U.S. Appl. No. 12/539,195, Response filed Dec. 20, 2012 to Non Final Office Action mailed Jul. 20, 2012, 7 pgs.
U.S. Appl. No. 12/548,051, Non Final Office Action mailed Jan. 24, 2013, 12 pgs.

(56) References Cited

OTHER PUBLICATIONS

U.S. Appl. No. 12/548,051, Response filed Apr. 24, 2013 to Non Final Office Action mailed Jan. 24, 2013, 8 pgs.
U.S. Appl. No. 12/548,051, Response filed Sep. 19, 2012 to Final Office Action mailed Apr. 19, 2012, 8 pgs.
U.S. Appl. No. 12/644,188 , Response filed Feb. 19, 2013 to Non Final Office Action mailed Sep. 19, 2012, 6 pgs.
U.S. Appl. No. 12/644,188, Final Office Action mailed May 22, 2013, 7 pgs.
U.S. Appl. No. 12/644,188, Non Final Office Action mailed Sep. 19, 2012, 8 pgs.
U.S. Appl. No. 13/776,557, filed Feb. 25, 2013, System for Hearing Assistance Device Including Receiver in the Canal.

* cited by examiner

RECEIVER-IN-CANAL HEARING DEVICE CABLE CONNECTIONS

CLAIM OF PRIORITY

This application claims the benefit under 35 U.S.C. §119 (e) of U.S. Provisional Patent Application Ser. No. 61/364,358, filed Jul. 14, 2010, which is incorporated herein by reference in its entirety.

FIELD OF THE INVENTION

The present subject matter relates generally to hearing assistance devices, including, but not limited to hearing aids, and in particular to hearing aids having wired connections to a behind-the-ear component.

BACKGROUND

Modern hearing assistance devices include a number of connectors for an increasing array of connected device components. For example, hearing aids include receiver-in-canal designs that feature a receiver disposed near or in the wearer's ear canal that is connected by a wires. Other apparatus may be connected to the hearing aid as well. These connections can pose problems with regard to reliability, ease of use, and modular replacement.

What is needed in the art are improved connections for hearing assistance devices.

SUMMARY

Disclosed herein, among other things, are methods and apparatus for hearing assistance devices, including, but not limited to connections for receiver-in-canal hearing devices. In various embodiments, a hearing device includes a hearing device component adapted to rest on or behind the ear and hearing assistance electronics disposed in the component. A first connector portion is disposed in the component, the first connector portion electrically connected to the hearing assistance electronics. A second connector portion is adapted to conform to a portion of the component and to electrically and physically connect a cable to the first connector portion. In various embodiments, at least one of the first connector portion and the second connector portion employ scratch pads for contacts. The first connector portion is top loading, in an embodiment.

Various embodiments include a method for providing a connection between a hearing device component adapted to rest on or behind the ear and a cable. The method includes mounting a first connector portion in the component, the first connector portion electrically connected to hearing assistance electronics disposed in the component. The method also includes connecting a second connector portion to the cable, the second connector portion adapted to conform to a portion of the component and to electrically and physically connect the cable to the first connector portion.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter includes various embodiments of a multi-point sealed connector assembly designed to facilitate the coupling of one or more in the ear transducers and other devices to a receiver-in-canal (RIC) hearing device.

Figure 1A:
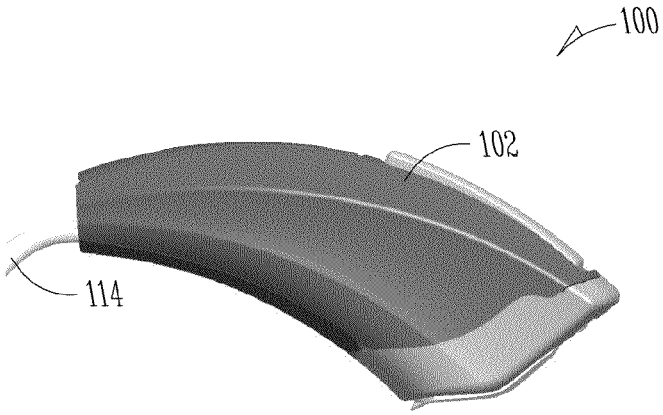
FIG. 1A shows a behind-the-ear or on-the-ear component of a receiver-in-canal hearing device according to one embodiment of the present subject matter.
Figure 1B:
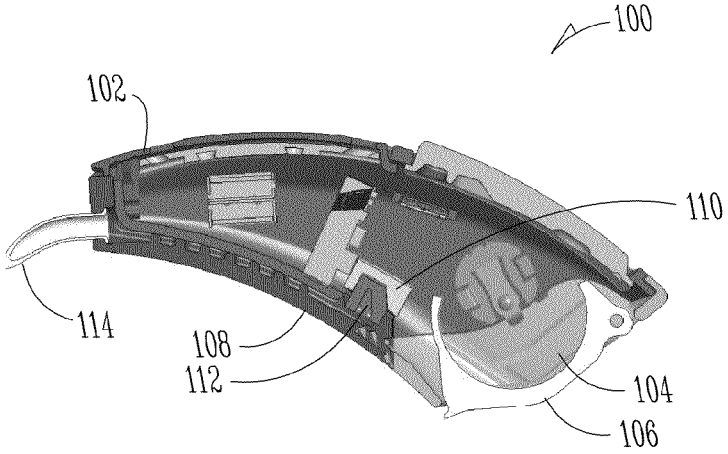
FIG. 1B shows a cross sectional drawing of the hearing assistance device of FIG. 1A according to one embodiment of the present subject matter.
Figure 1C:
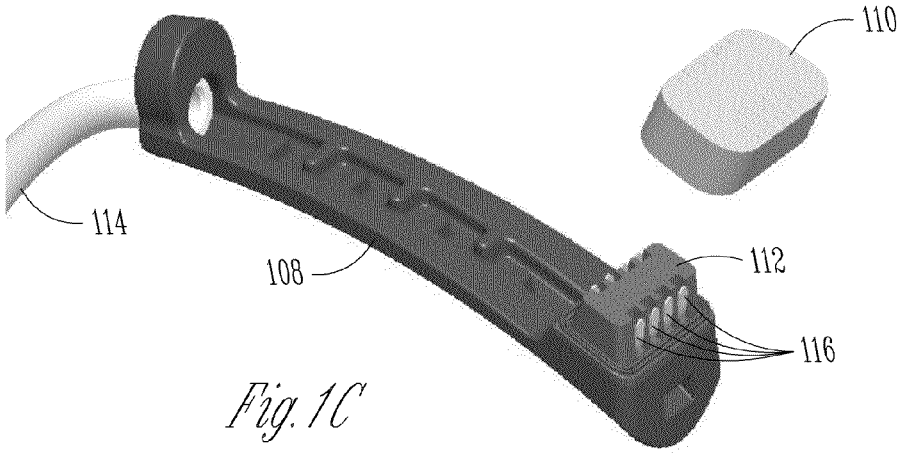
FIGS. 1C and 1D show different perspective drawings of the connector and socket of FIGS. 1A and 1B, according to one embodiment of the present subject matter.
Figure 1D:
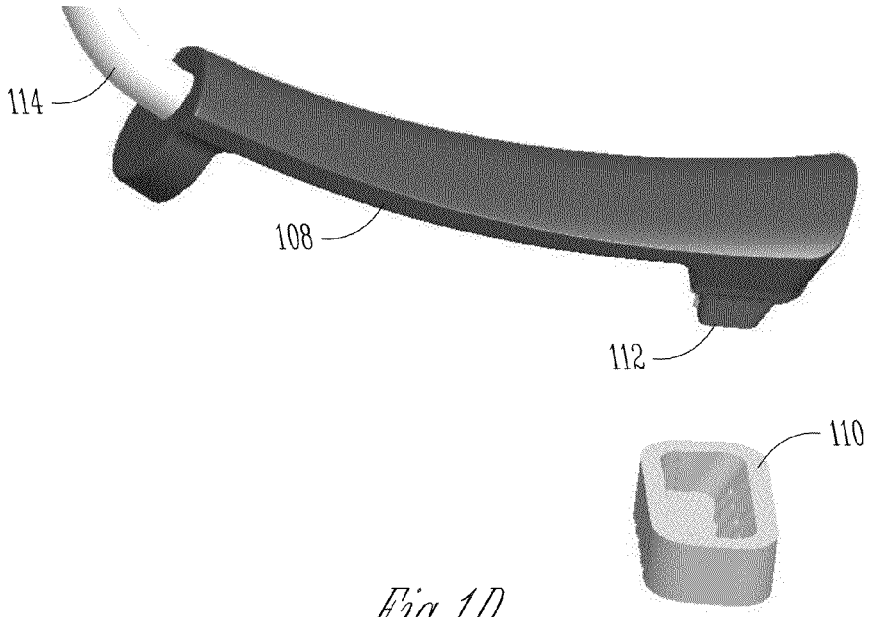

FIG. 1A shows a behind-the-ear or on-the-ear component 102 of a receiver-in-canal hearing device 100 according to one embodiment of the present subject matter. The component 102 typically includes a microphone, signal processing electronics, a power source, and a connection for a wired receiver adapted to fit near or in the ear canal of the wearer. In various embodiments, the component 102 may include a plurality of controls for controlling the hearing assistance device 100. FIG. 1B shows a cross sectional drawing of the hearing assistance device 100 according to one embodiment of the present subject matter. It is understood that configurations of the hearing assistance device 100 may vary. This configuration is intended to demonstrate one aspect of the present connector according to one embodiment of the present subject matter. Component 102 includes the battery 104 and battery door 106 and associated contacts. The electronics are connected to the battery 104 and a socket 110. The wired receiver (not shown) is attached via a cable 114 to a connector 108. In this embodiment connector 108 includes a plug 112 adapted to mate with socket 110 to provide connections to the cable 114 and any attached components. Such attached components may include one or more of a receiver, a plurality of receivers, a microphone, a plurality of microphones, a magnetic sensing device (such as a telecoil, a magnetoresistive sensor, a GMR, an AMR, a TMR, or other magnetic sensing device), an antenna, or other device or sensor. In various embodiments, various combinations are accommodated. FIGS. 1C and 1D show different perspective drawings of the connector 108 and socket 110, according to one embodiment of the present subject matter. It is understood that the connector 108 may include socket instead of a plug without departing from the scope of the present subject matter. In various embodiments, tools are not required to remove the cable 114.

In various embodiments, the connector 108 provides electrical connections and seals at least a portion of the component 102. In various embodiments, the connector 108 is pliable. In various embodiments the connector 108 is rigid. In various embodiments the connector 108 includes rigid and pliable portions. In various embodiments, the connections are performed by running wires along the connector 108 to the plug 112. In various embodiments electrical traces are used to make the connections. In various embodiments a flexible conductive connector is used to make the connections. Other connections are possible without departing from the scope of the present subject matter.

Socket 110 is demonstrated to have surface mount connections for mounting to the component 102, however, it is understood that other connections may be used without departing from the present subject matter. In the embodiment shown 8 contacts 116 are demonstrated, however, it is understood that other numbers of contacts and types of contacts may be used without departing from the scope of the present subject matter. In various embodiments the connections are achieved via scratching contacts. In various embodiments, pins and pads are used. Combinations of scratching contacts, pins and pads may be employed without departing from the scope of the present subject matter. In various embodiments the transmission of signal is through twisted pair and shielded combination wire assemblies through a custom formed tube. The shielded wires prevent adverse affects on the signal due to EMI and prevent crosstalk between the transducers. In one embodiment, the primary connection is moved back in the device to an area in front of the battery. This allows for a smaller device while facilitating better directionality by moving the front microphone forward about 2 to 4 mm. This placement also results in a more robust design by eliminating the effects of wiggle and other movements on the cable from affecting the connector area. In various embodiments, sealing of the assemblies is accomplished by a molded in place elastomeric gasket that radially seals the connector from the outside environment. Other approaches are possible without departing from the present subject matter.

Some advantages of the present subject matter include, but are not limited to, that in various embodiments a fully keyed assembly can be produced which makes it difficult or even impossible to accidentally misalign. In various embodiments the connection is moved from the front of device (which is usually the smallest area) back to just in front of the battery (which may be the widest area in some designs). The present subject matter also provides better directionality via forward microphone placement. The present subject matter also may use the device case as a retention feature. In various embodiments, the present subject matter lowers cable exit out of the snout yielding a lower profile device. In various embodiments, the present subject matter provides a larger connector that may be easier to handle. The present subject matter in various embodiments may yield a tamper-resistant locking feature. In various embodiments, the present subject matter provides larger contact area that affords wider tolerances. In various embodiments, the present subject matter provides balance bars that prevent contact spring on one side from biasing the other.

Figure 2A:
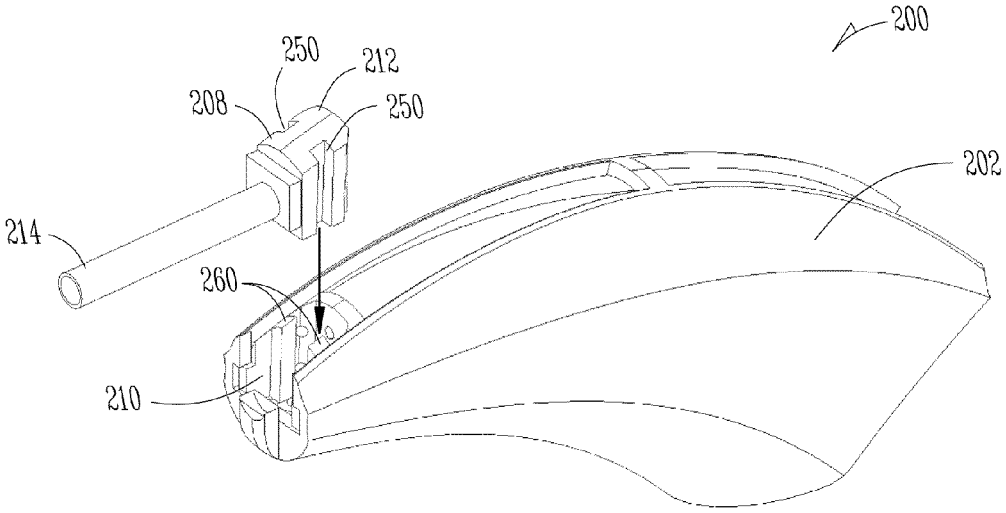
FIG. 2A shows a top loading connector, according to one embodiment of the present subject matter.
Figure 2B:
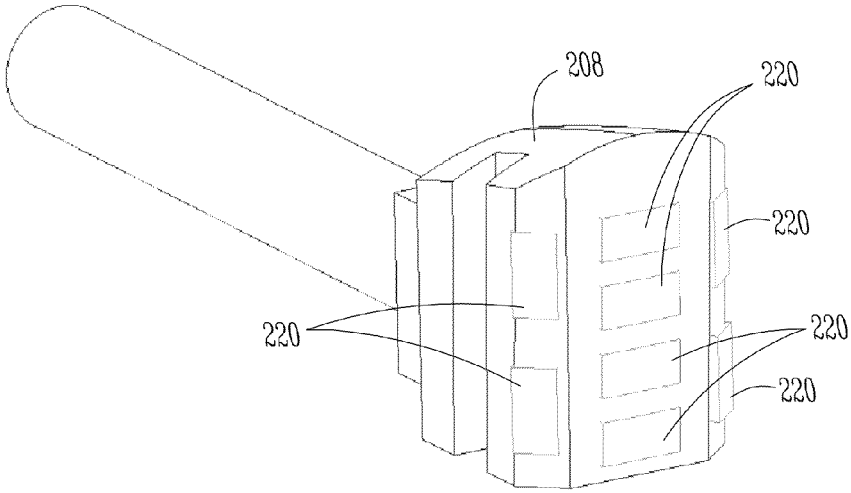
FIG. 2B shows an embodiment of the connector of FIG. 2A where the connections are performed using scratch pads, according to one embodiment of the present subject matter.
Figure 2C:
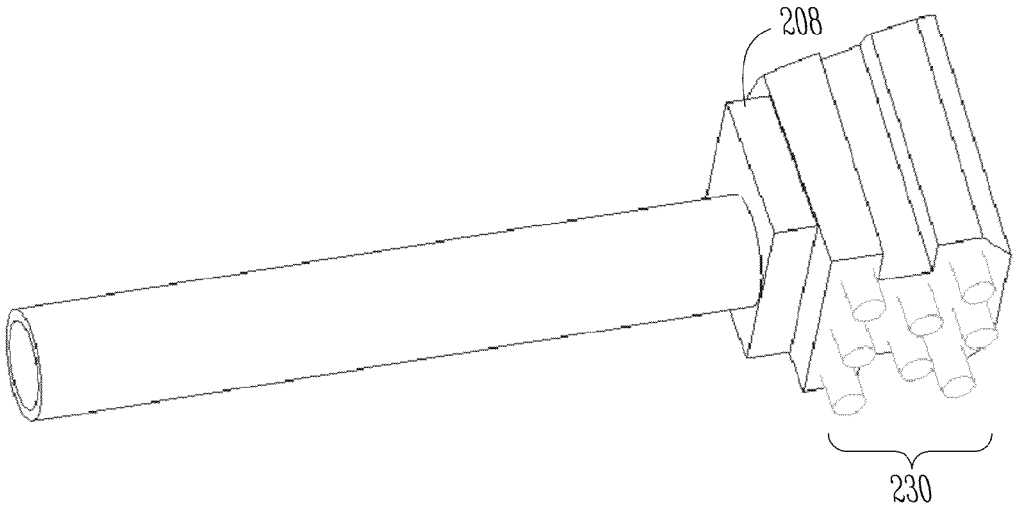
FIG. 2C shows an embodiment of the connector of FIG. 2A where the connections are performed using pins, according to one embodiment of the present subject matter.

FIG. 2A shows a top loading connector according to one embodiment of the present subject matter. Component 202 of hearing assistance device 200 has a socket 210 which receives a plug 212 in connector 208 to connect to cable 214. In the embodiment shown connector 208 has a grooved assembly adapted to slide along ridges 260 in the socket of component 202. Other retention mechanisms can be employed in various embodiments, without departing from the scope of the present subject matter. FIG. 2B and FIG. 2C show embodiments where the connections are performed using scratch pads 220 and pins 230, respectively.

FIG. 2A shows a behind-the-ear or on-the-ear component 202 of a receiver-in-canal hearing aid 200. The component 202 typically includes a microphone, signal processing electronics, a power source, and a connection for a wired receiver adapted to fit near or in the ear canal of the wearer. In various embodiments, the component 202 may include a plurality of controls for controlling the hearing assistance device 200. It is understood that configurations of the hearing assistance device 200 may vary. This configuration is intended to demonstrate one aspect of the present connector according to one embodiment of the present subject matter. Component 202 includes a battery, a battery door and associated contacts. The electronics are connected to the battery and a socket 210. The wired receiver (not shown) is attached via a cable 214 to a connector 208. In this embodiment connector 208 includes a plug 212 adapted to mate with socket 210 to provide connections to the cable 214 and any attached components. Such attached components may include one or more of a receiver, a plurality of receivers, a microphone, a plurality of microphones, a magnetic sensing device (such as a telecoil, a magnetoresistive sensor, a GMR, an AMR, a TMR, or other magnetic sensing device), an antenna, or other sensor. In various embodiments, various combinations are accommodated. It is understood that the connector 208 may include socket instead of a plug without departing from the scope of the present subject matter. In various embodiments, tools are not required to remove the cable 214.

In various embodiments, the connector 208 provides electrical connections and seals at least a portion of the component 202. In various embodiments, the connector 208 is pliable. In various embodiments the connector 208 is rigid. In various embodiments the connector 208 includes rigid and pliable portions. In various embodiments, the connections are performed by running wires along the connector 208 to the plug 212. In various embodiments electrical traces are used to make the connections. In various embodiments a flexible conductive connector is used to make the connections. Other connections are possible without departing from the scope of the present subject matter.

In various embodiments, socket 210 has surface mount connections for mounting to the component 202. Other connections may be used without departing from the present subject matter. In the embodiment shown 8 contacts are demonstrated, however, it is understood that other numbers of contacts and types of contacts may be used without departing from the scope of the present subject matter. In various embodiments the connections are achieved via scratching contacts. In various embodiments, pins and pads are used. Combinations of scratching contacts, pins and pads may be employed without departing from the scope of the present subject matter. In various embodiments the transmission of signal is through twisted pair and shielded combination wire assemblies through a custom formed tube. The shielded wires prevent adverse affects on the signal due to EMI and prevent crosstalk between the transducers. In various embodiments, sealing of the assemblies is accomplished by a molded in place elastomeric gasket that radially seals the connector from the outside environment. Other approaches are possible without departing from the present subject matter.

Some advantages of the present subject matter include, but are not limited to, that in various embodiments a fully keyed assembly can be produced which makes it difficult or even impossible to accidentally misalign. The present subject matter in various embodiments may yield a tamper-resistant locking feature. In various embodiments, the present subject matter provides larger contact area that affords wider tolerances. In various embodiments, the top loading connector approach provides significantly increased resistance to loss of signal caused by cable twisting, bending or pull-out. A less intuitive insertion direction makes it more difficult for patient removal of the cable.

Figure 3:
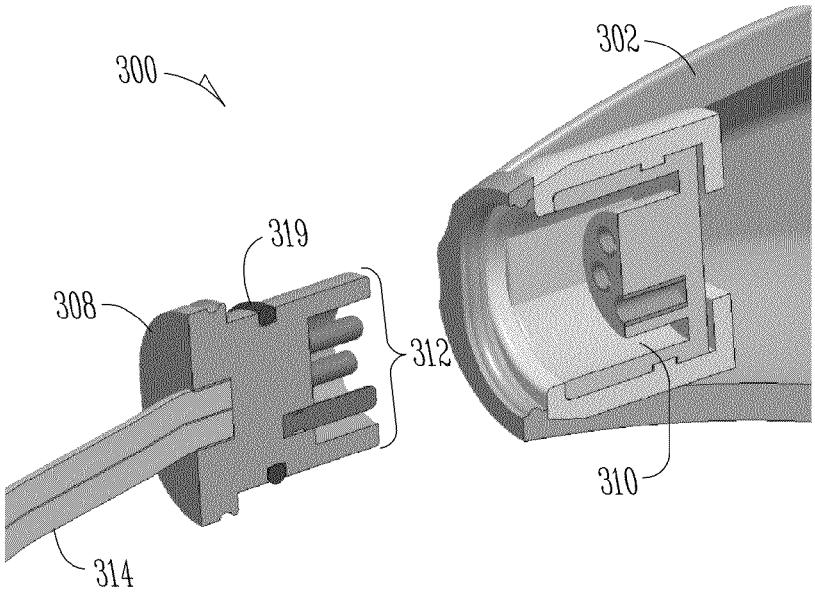
FIG. 3 shows a variation of the front load cable connection approach according to one embodiment of the present subject matter.

FIG. 3 shows a variation of the front load cable connection approach according to one embodiment of the present subject matter. Component 302 of hearing assistance device 300 has a socket 310 which receives a plug 312 of connector 308 to connect to cable 314. In the embodiment shown connector 308 has a pinned assembly adapted to slide into the socket 310 of component 302. Other retention mechanisms can be employed in various embodiments, without departing from the scope of the present subject matter. In various embodiments the connections are performed by scratch pads, or scratch pads in combination with pins. Other connections are possible without departing from the scope of the present subject matter.

FIG. 3 shows a cross section of a portion of the behind-the-ear or on-the-ear component 302 of a receiver-in-canal hearing aid 300. The component 302 typically includes a microphone, signal processing electronics, a power source, and a connection for a wired receiver adapted to fit near or in the ear canal of the wearer. In various embodiments, the component 302 may include a plurality of controls for controlling the hearing assistance device 300. It is understood that configurations of the hearing assistance device 300 may vary. This configuration is intended to demonstrate one aspect of the present connector according to one embodiment of the present subject matter. Component 302 includes a battery, a battery door and associated contacts. The electronics are connected to the battery and a socket 310. The wired receiver (not shown) is attached via a cable 314 to a connector 308. In this embodiment connector 308 includes a plug 312 adapted to mate with socket 310 to provide connections to the cable 314 and any attached components. Such attached components may include one or more of a receiver, a plurality of receivers, a microphone, a plurality of microphones, a magnetic sensing device (such as a telecoil, a magnetoresistive sensor, a GMR, an AMR, a TMR, or other magnetic sensing device), an antenna, or other sensor. In various embodiments, various combinations are accommodated. It is understood that the connector 308 may include socket instead of a plug without departing from the scope of the present subject matter. In various embodiments, tools are not required to remove the cable 314.

In various embodiments, the connector 308 provides electrical connections and seals at least a portion of the component 302. One such approach is the use of seal 319 that provides a seal to socket 310. In various embodiments, the connector 308 is pliable. In various embodiments the connector 308 is rigid. In various embodiments the connector 308 includes rigid and pliable portions. In various embodiments, the connections are performed by running wires along the connector 308 to the plug 312. In various embodiments electrical traces are used to make the connections. In various embodiments a flexible conductive connector is used to make the connections. Other connections are possible without departing from the scope of the present subject matter.

In various embodiments, socket 310 may have surface mount connections for mounting to the component 302. Other connections may be used without departing from the present subject matter. In the embodiment shown a 5 contact system is demonstrated, however, it is understood that other numbers of contacts and types of contacts may be used without departing from the scope of the present subject matter. In various embodiments the connections are achieved via scratching contacts. In various embodiments, pins and pads are used. Combinations of scratching contacts, pins and pads may be employed without departing from the scope of the present subject matter. In various embodiments the transmission of signal is through twisted pair and shielded combination wire assemblies through a custom formed tube. The shielded wires prevent adverse affects on the signal due to EMI and prevent crosstalk between the transducers. In various embodiments, sealing of the assemblies is accomplished by a molded in place elastomeric gasket 319 that radially seals the connector from the outside environment. Other approaches are possible without departing from the present subject matter.

This present embodiments provide among other things a connection between the self contained "modular" RIC cable assembly and the hearing device. The unique pin and socket designs can be produced with different approaches including, but not limited to, injection molding. The approach can provide a plurality of connection numbers and configurations and can be used across a wide variety of "RIC" products. In various embodiments the cable is a solid core tube co-extruded with the wires giving the wires a strain relief the length of the cable thus eliminating the need for a "service" loop strain relief. The wires are then either soldered or crimped to the pins which then is insert molded into a unique shaped plastic pin housing which provides an environmentally safe condition and also that when molded the pins are recessed (protected) within the plastic housing. The pin housing also holds the o-ring 319 for an environmental seal and keying features for proper alignment with the socket sub assembly. The socket sub assembly has a molded component which holds the sockets in place and has the mating alignment features that accepts the pin sub assembly and is housed in the hearing device with tongue and groove type alignment and holding features. The design of the socket sub assembly is such that it can be soldered to the "flex" PCB in the flat state and then folded and assembled accurately and easily into the "spine" of the hearing device. This "insert molded" pin and socket connection gives the user a robust connection that has a positive tactile feel when connecting and is "user friendly" when disconnecting.

Some advantages of the present subject matter include, but are not limited to, that in various embodiments a fully keyed assembly can be produced which makes it difficult or even impossible to accidentally misalign. The present subject matter in various embodiments may yield a tamper-resistant locking feature. In various embodiments, the present subject matter provides larger contact area that affords wider tolerances. A more positive tactile feel and robust RIC cable assembly connection is provided that does not require any tools or the use of hearing device parts (such as the microphone cover) for the assembly and disassembly of the RIC cable assembly.

In various embodiments using an antenna is understood that antenna can be any of a variety of antenna types, including a tuned antenna, a multiband antenna, and a broadband antenna. It is understood that antenna can be a variety of structures, including, but not limited to a single element or an antenna array. Some antenna configurations and related teachings include but are not limited to the following patent applications, which are all hereby incorporated by reference in their entirety: U.S. patent application Ser. Nos. 10/768,735 (now issued as U.S. Pat. No. 7,256,747); 11/676,420 (now issued as U.S. Pat. No. 7,446,720); 11/357,751 (now issued as U.S. Pat. No. 7,593,538); 12/027,151, filed Feb. 6, 2008; 12/550,821, filed Aug. 31, 2009; 12/340,600, filed Dec. 19, 2008; 12/340,604, filed Dec. 19, 2008; and 12/638,720, filed Dec. 15, 2009. Other antenna configurations and hardware are possible without departing from the scope of the present subject matter.

It is understood that various tuning approaches can be used including, but not limited to, selection of a tuned antenna appropriate for the frequency of operation from a plurality of tuned antennas, automatic matching of an antenna for a selected frequency of operation, a broadband antenna approach and combinations of the foregoing.

In various embodiments the electronics includes a processor adapted to perform hearing assistance processing. In various embodiments the processor includes a digital signal processor. In various embodiments processor includes a microprocessor. In various embodiments processor includes combinational logic. In various embodiments processor is a microcontroller. For example, in hearing aid applications the processor is adapted to perform functions associated with programmable gain to improve hearing of a subject with hearing loss. Some embodiments may include one or more aspects including, but not necessarily limited to sub band processing, acoustic feedback cancellation, entrainment reduction, adjustable gain, compression, and/or limiting.

It is understood that variations in designs, contact count and configurations, and combinations of components may be employed without departing from the scope of the present subject matter. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

The present subject matter can be used for a variety of hearing assistance devices, including but not limited to, cochlear implant type hearing devices, and hearing aids, such as behind-the-ear (BTE) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A receiver-in-canal (RIC) hearing device comprising:

a hearing device component adapted to rest on or behind an ear of a wearer;

hearing assistance electronics disposed in the component;

a transducer configured to be placed in the ear;

a first connector portion disposed in the component, the first connector portion electrically connected to the hearing assistance electronics;

a second connector portion adapted to conform to a portion of the component and to electrically and physically connect a cable to the first connector portion, wherein the cable is configured to electrically connect to the transducer at a distal end; and wherein the first connector portion and the second connector portion employ scratch pads for electrical contacts, and wherein at least one of the first and second connector portions are top loading, such that the at least one connector portion is inserted approximately perpendicular to the cable.

2. The hearing device of claim 1, wherein at least one of the first connector portion and the second connector portion is located on a portion of the hearing device component closest to a back of the ear when worn.

3. The hearing device of claim 1, wherein the second connector portion is rigid.

4. The hearing device of claim 1, wherein the second connector portion is pliable.

5. The hearing device of claim 1, wherein the second connector portion includes rigid and pliable portions.

6. The hearing device of claim 1, wherein the first connector portion includes a socket and the second connector portion includes a plug.

7. The hearing device of claim 6, wherein the socket includes a surface mount connection for mounting to the component.

8. The hearing device of claim 6, wherein the plug includes a grooved assembly and the socket includes ridges, and wherein the grooved assembly is adapted to slide along ridges to mate with the socket.

9. The hearing device of claim 1, wherein at least one of the first connector portion and the second connector portion employ pins and pads for contacts.

10. The hearing device of claim 1, wherein at least one of the first connector portion and the second connector portion employ a combination of scratching contacts and pins and pads for contacts.

11. The hearing device of claim 1, further comprising an elastomeric gasket adapted to seal the connectors from an outside environment.

12. The hearing device of claim 1, wherein the first connector portion is configured to be mounted using a housing of the device as a retention feature.

13. The hearing device of claim 1, wherein the second connector portion is configured to be connected using a tamper resistant locking feature.

14. A method for providing a connection between a receiver-in-canal (RIC) hearing device component adapted to rest on or behind an ear of a wearer and a cable, the method comprising:

mounting a first connector portion in the component, the first connector portion electrically connected to hearing assistance electronics disposed in the component; and connecting a second connector portion to the cable, the second connector portion adapted to conform to a portion of the component and to electrically and physically connect the cable to the first connector portion, wherein the cable is configured to electrically connect to a transducer configured to be placed in the ear, and wherein the first connector portion and the second connector portion employ scratch pads for electrical contacts, and wherein at least one of the first and second connector portions are top loading, such that the at least one connector portion is inserted approximately perpendicular to the cable.

15. The method of claim 14, wherein the first connector portion includes a socket and the second connector portion includes a plug.

16. The method of claim 15, wherein the plug includes a grooved assembly and the socket includes ridges, and wherein the grooved assembly is adapted to slide along ridges to mate with the socket.

17. The method of claim 14, wherein connecting the second connector portion to the cable includes connecting the second connector portion to the cable having a connection to a wired receiver adapted to fit near or in the ear canal of the wearer.

18. The method of claim 14, wherein mounting a first connector portion in the component includes electrically connecting the first connector portion to at least one of a microphone, signal processing electronics, and a battery.

19. The method of claim 14, wherein mounting a first connector portion includes using a housing of the device as a retention feature.

20. The method of claim 14, wherein connecting a second connector portion includes using a tamper resistant locking feature.

* * * * *

UNITED STATES PATENT AND TRADEMARK OFFICE

CERTIFICATE OF CORRECTION

PATENT NO. : 8,638,965 B2
APPLICATION NO. : 13/181752
DATED : January 28, 2014
INVENTOR(S) : Higgins et al.

It is certified that error appears in the above-identified patent and that said Letters Patent is hereby corrected as shown below:

On the title page, in column 2, References Cited under "Other Publications", line 1, delete "11/857,439 ," and insert --11/857,439,--, therefor On title page 2, in column 2, References Cited under "Other Publications", line 7, delete "12/548,051,Final" and insert --12/548,051, Final--, therefor On title page 2, in column 2, References Cited under "Other Publications", line 13, after "Requirement", delete "Action", therefor On title page 2, in column 2, References Cited under "Other Publications", line 24, delete "Mailed" and insert --mailed--, therefor On title page 2, in column 2, References Cited under "Other Publications", line 33, delete "Filed" and insert --filed--, therefor On title page 2, in column 2, References Cited under "Other Publications", line 39, delete "Filed:" and insert --filed--, therefor On title page 2, in column 2, References Cited under "Other Publications", line 41, delete "Mailed" and insert --mailed--, therefor On title page 2, in column 2, References Cited under "Other Publications", line 46, delete "L S," and insert --L. S.,--, therefor On title page 3, in column 1, References Cited under "Other Publications", line 5, delete "12/644,188 ," and insert --12/644,188,--, therefor Signed and Sealed this
Eighteenth Day of November, 2014

Michelle K. Lee

Michelle K. Lee
*Deputy Director of the United States Patent and Trademark Office*